US009162478B2

(12) United States Patent
Suzuki

(10) Patent No.: US 9,162,478 B2
(45) Date of Patent: Oct. 20, 2015

(54) IMAGE RECORDING APPARATUS AND NONTRANSITORY STORAGE MEDIUM STORING PROGRAM

(75) Inventor: Katsuaki Suzuki, Gifu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 424 days.

(21) Appl. No.: 13/565,580

(22) Filed: Aug. 2, 2012

(65) Prior Publication Data

US 2013/0033538 A1 Feb. 7, 2013

(30) Foreign Application Priority Data

Aug. 3, 2011 (JP) ..... 2011-170057

(51) Int. Cl.
*B41J 2/21* (2006.01)

(52) U.S. Cl.
CPC ..... *B41J 2/2146* (2013.01); *B41J 2/2114* (2013.01)

(58) Field of Classification Search
CPC ..... B41J 2/2114
USPC ..... 347/13
See application file for complete search history.

(56) References Cited

U.S. PATENT DOCUMENTS 4,831,409 A * 5/1989 Tatara et al. ..... 347/115
6,378,976 B1 * 4/2002 Byers et al. ..... 347/19
6,775,022 B2 * 8/2004 Noyes et al. ..... 358/1.15
2005/0093952 A1 * 5/2005 Hoshino ..... 347/102
2007/0064077 A1 3/2007 Konno
2009/0289985 A1 11/2009 Sumida et al.

FOREIGN PATENT DOCUMENTS

JP 2005-132073 A 5/2005
JP 2007-106114 A 4/2007
JP 2008-207492 A 9/2008
JP 2009-279777 A 12/2009

OTHER PUBLICATIONS

Office Action issued in related Japanese Patent Application No. 2011-170057, mailed Feb. 3, 2015.

* cited by examiner

*Primary Examiner* — Manish S Shah
*Assistant Examiner* — Jeffrey C Morgan
(74) *Attorney, Agent, or Firm* — Merchant & Gould PC

(57) ABSTRACT

An image recording apparatus, including: a first head for ejecting first liquid; a second head for ejecting second liquid; a second-liquid test-pattern recording command section configured to command recording of a test pattern of the second liquid on the recording medium; and an output controller configured to output recording data to the first head and/or the second head. When the second-liquid test-pattern recording command section does not command the recording of the test pattern of the second liquid, the output controller outputs recording data representative of an image to be recorded, to the first head and the second head. When the second-liquid test-pattern recording command section commands the recording of the test pattern of the second liquid, the output controller outputs the recording data representative of the test pattern of the second liquid, not to the first head but to the second head.

5 Claims, 7 Drawing Sheets

IMAGE RECORDING APPARATUS AND NONTRANSITORY STORAGE MEDIUM STORING PROGRAM

CROSS REFERENCE TO RELATED APPLICATION

The present application claims priority from Japanese Patent Application No. 2011-170057, which was filed on Aug. 3, 2011, the disclosure of which is herein incorporated by reference in its entirety.

BACKGROUND OF THE INVENTION

1. Field of the Invention

The present invention relates to an image recording apparatus configured to eject, onto a recording medium, second liquid for coagulating or precipitating a constituent of first liquid before the first liquid is ejected, and relates to a nontransitory storage medium storing a program to be executed by a computer of the inane recording apparatus.

2. Description of the Related Art

There is known a printer configured to eject pretreatment liquid (second liquid) for coagulating or precipitating a coloring agent of ink (first liquid) in order to reduce spreading of the ink formed on a sheet. In such a printer, the pretreatment liquid is ejected, before the ink is ejected, onto areas on each of which a dot is to be formed.

SUMMARY OF THE INVENTION

From a viewpoint of reducing consumption of the pretreatment liquid, the pretreatment liquid is preferably applied only to areas on each of which an ink dot is to be formed. In some printers, a control circuit is configured to execute an ejection control using image data for an image to be recorded, such that the ink and the pretreatment liquid are ejected onto the same positions. In this configuration, it is possible to consider that the printer is configured such that the pretreatment liquid is not applied in the recording depending upon needs of a user. However, since the pretreatment liquid is transparent, it has not been assumed that recording is performed by ejecting only the pretreatment liquid without ejecting the ink. However, an inventor of the present invention has found that, when a test pattern is recorded for adjusting a pretreatment-liquid head, the pretreatment-liquid head can be suitably adjusted by the test pattern using only the pretreatment liquid.

This invention has been developed to provide an image recording apparatus and a nontransitory storage medium storing a program to be executed by a computer of the image recording apparatus capable of recording a test pattern of only second liquid which does not overlap first liquid in a configuration in which ejections of the first liquid and the second liquid are controlled based on the same image data.

The present invention provides an image recording apparatus, comprising: a conveyor mechanism configured to convey a recording medium in a conveying direction; a first-liquid ejection head having at least one first ejection opening, the first-liquid ejection head configured to eject first liquid for recording an image on the recording medium through the first ejection opening; a second-liquid ejection head having at least one second ejection opening, the second-liquid ejection head configured to eject transparent liquid as second liquid through the second ejection opening; a recording-data storage device configured to store therein recording data representative of one of an image to be recorded and an image of a test pattern of the second liquid; a second-liquid test-pattern recording command section configured to command recording of the test pattern of the second liquid on the recording medium; and an output controller configured to output the recording data selectively to at least one of the first-liquid ejection head and the second-liquid ejection head, the output controller configured to: output the recording data representative of the image to be recorded, to the first-liquid ejection head and the second-liquid ejection head when the second-liquid test-pattern recording command section does not command the recording of the test pattern of the second liquid; and output the recording data representative of the test pattern of the second liquid, not to the first-liquid ejection head but to the second-liquid ejection head when the second-liquid test-pattern recording command section commands the recording of the test pattern of the second liquid.

The present invention provides an image recording apparatus, comprising: a conveyor mechanism configured to convey a recording medium in a conveying direction; a first-liquid ejection head having at least one first ejection opening, the first-liquid ejection head configured to eject first liquid for recording an image on the recording medium through the first ejection opening; a second-liquid ejection head having at least one second ejection opening, the second-liquid ejection head configured to eject transparent liquid as second liquid through the second ejection opening; a recording-data storage device configured to store therein recording data representative of one of an image to be recorded and an image of a test pattern of the second liquid; and an output controller configured to output the recording data selectively to at least one of the first-liquid ejection head and the second-liquid ejection head, wherein the recording data representative of the image to be recorded corresponds to an image recording command that is a command for recording the image to be recorded, on the recording medium, and wherein the recording data representative of the image of the test pattern of the second liquid corresponds to a test-pattern recording command that is a command for recording the image of the test pattern of the second liquid on the recording medium, the output controller configured to: output the recording data representative of the image to be recorded, to the first-liquid ejection head and the second-liquid ejection head when the image recording command is outputted; and output the recording data representative of the test pattern of the second liquid, not to the first-liquid ejection head but to the second-liquid ejection head when the test-pattern recording command is outputted.

The present invention provides a nontransitory storage medium storing a program to be executed by a computer of an image recording apparatus, the image recording apparatus comprising: a conveyor mechanism configured to convey a recording medium in a conveying direction; a first-liquid ejection head having at least one first ejection opening, the first-liquid ejection head configured to eject first liquid for recording an image on the recording medium through the first ejection opening; a second-liquid ejection head having at least one second ejection opening, the second-liquid ejection head configured to eject transparent liquid as second liquid through the second ejection opening; and a recording-data storage device configured to store therein recording data representative of one of an image to be recorded and an image of a test pattern of the second liquid, the program designed to have the computer function as: a second-liquid test-pattern recording command section configured to command recording of the test pattern of the second liquid on the recording medium; and an output controller configured to output the recording data selectively to at least one of the first-liquid ejection head and the second-liquid ejection head, the output controller configured to: output the recording data representative of the image to be recorded, to the first-liquid ejection head and the second-liquid ejection head when the second-liquid test-pattern recording command section does not command the recording of the test pattern of the second liquid; and output the recording data representative of the test pattern of the second liquid, not to the first-liquid ejection head but to the second-liquid ejection head when the second-liquid test-pattern recording command section commands the recording of the test pattern of the second liquid.

According to the present invention, when the test pattern of the second liquid is recorded on the recording medium in a configuration in which common recording data is supplied selectively to at least one of the first and second-liquid ejection heads, the recording data representative of the test pattern of the second liquid is outputted only to the second-liquid ejection head, making it possible to record the test pattern of only the second liquid which does not overlap the first liquid.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which:

First Embodiment

Figure 1:
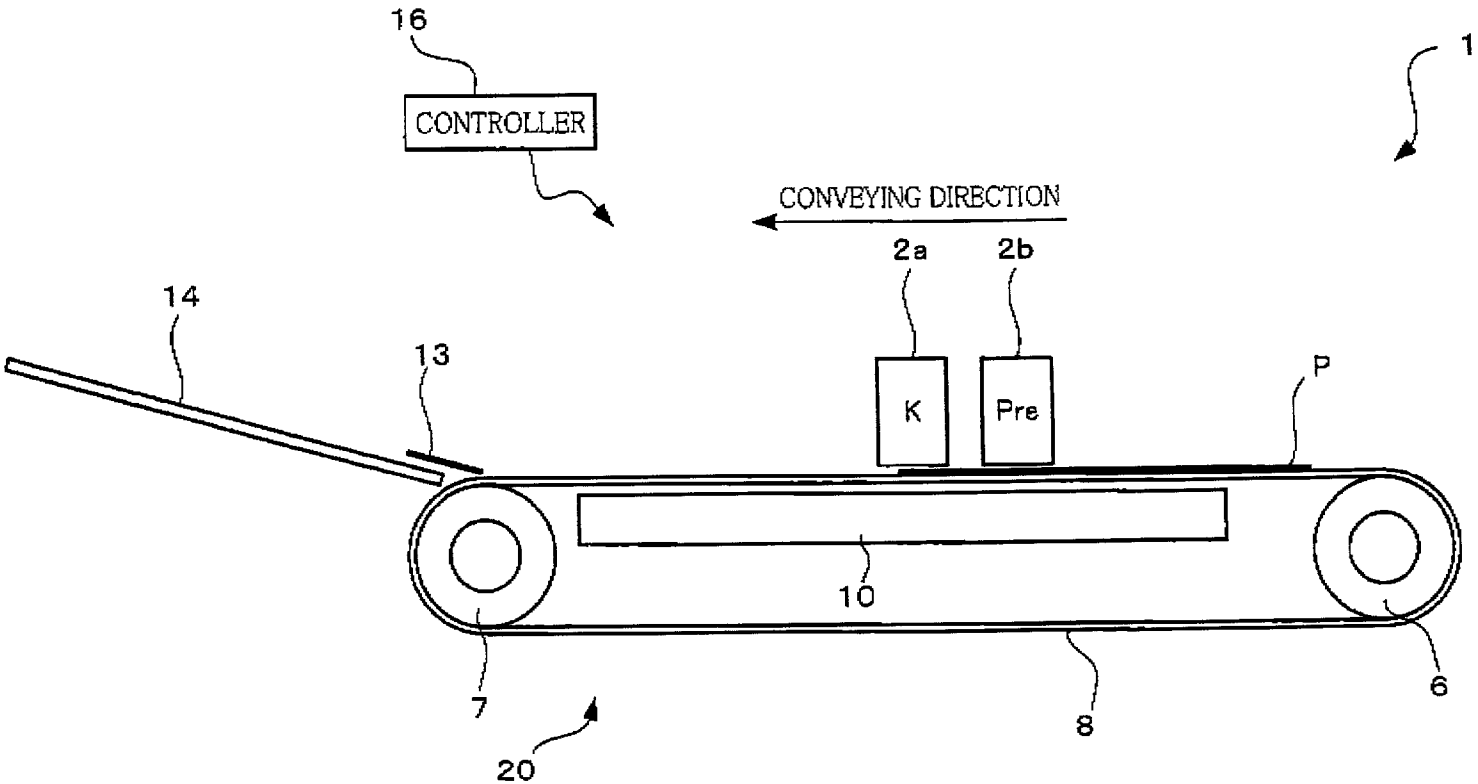
FIG. 1 is a side view generally showing an ink-jet printer as a first embodiment of the present invention.

As shown in FIG. 1, an ink-jet printer 1 includes a conveyor mechanism 20, an ink head 2*a* (as one example of a first-liquid ejection head), a precoat head 2*b* (as one example of a second-liquid ejection head), and a controller 16. The ink head 2*a* has ejection openings formed therein for ejecting droplets of black ink (K) (as one example of first liquid) onto a recording medium in the form of a sheet P conveyed by the conveyor mechanism 20. The precoat head 2*b* has ejection openings formed therein for ejecting droplets of precoat liquid (Pre) (as one example of second liquid) that coagulates or precipitates a coloring agent of the ink.

In the conveyor mechanism 20, belt rollers 6, 7 are rotated to rotate a conveyor belt 8, whereby the sheet P placed on the conveyor belt 8 is conveyed through positions between the heads 2*a*, 2*b* and a platen 10. When the sheet P is conveyed through a position just under the precoat head 2*b*, the precoat head 2*b* ejects droplets of the precoat liquid so as to apply the precoat liquid on areas on which an image is to be formed on an upper face of the sheet P. Then, when the sheet P is conveyed through a position just under the ink head 2*a*, the ink head 2*a* ejects the ink droplets onto the areas on which the precoat liquid has been applied on the upper face of the sheet P. As a result, a desired image is formed on the sheet P. When the ink droplet is landed on the precoat liquid on the sheet P, the precoat liquid acts on the ink droplet and coagulates or precipitates the coloring agent of the ink droplet, thereby preventing ink spreading on the sheet P. Precoat liquid for coagulating pigments is used for pigment ink, and precoat liquid for precipitating dyes is used for dye ink. The precoat liquid may be any suitable liquid such as liquid containing a cationic high polymer and/or polyvalent metal salt such as magnesium salt. When the ink is landed on the area on the sheet P on which the precoat liquid has been applied, the polyvalent metal salt or the like coagulates or precipitates the dyes or the pigments as the coloring agent of the ink, thereby forming an insoluble or hardly soluble metal complex and so on. As a result, a degree of penetration of the landed ink into the sheet P is lowered, which facilitates fixing the ink on the sheet P. The sheet P on which the image has been recorded is peeled from the conveyor belt 8 by a peeling plate 13 and discharged onto a sheet-discharge portion 14.

Figure 2:
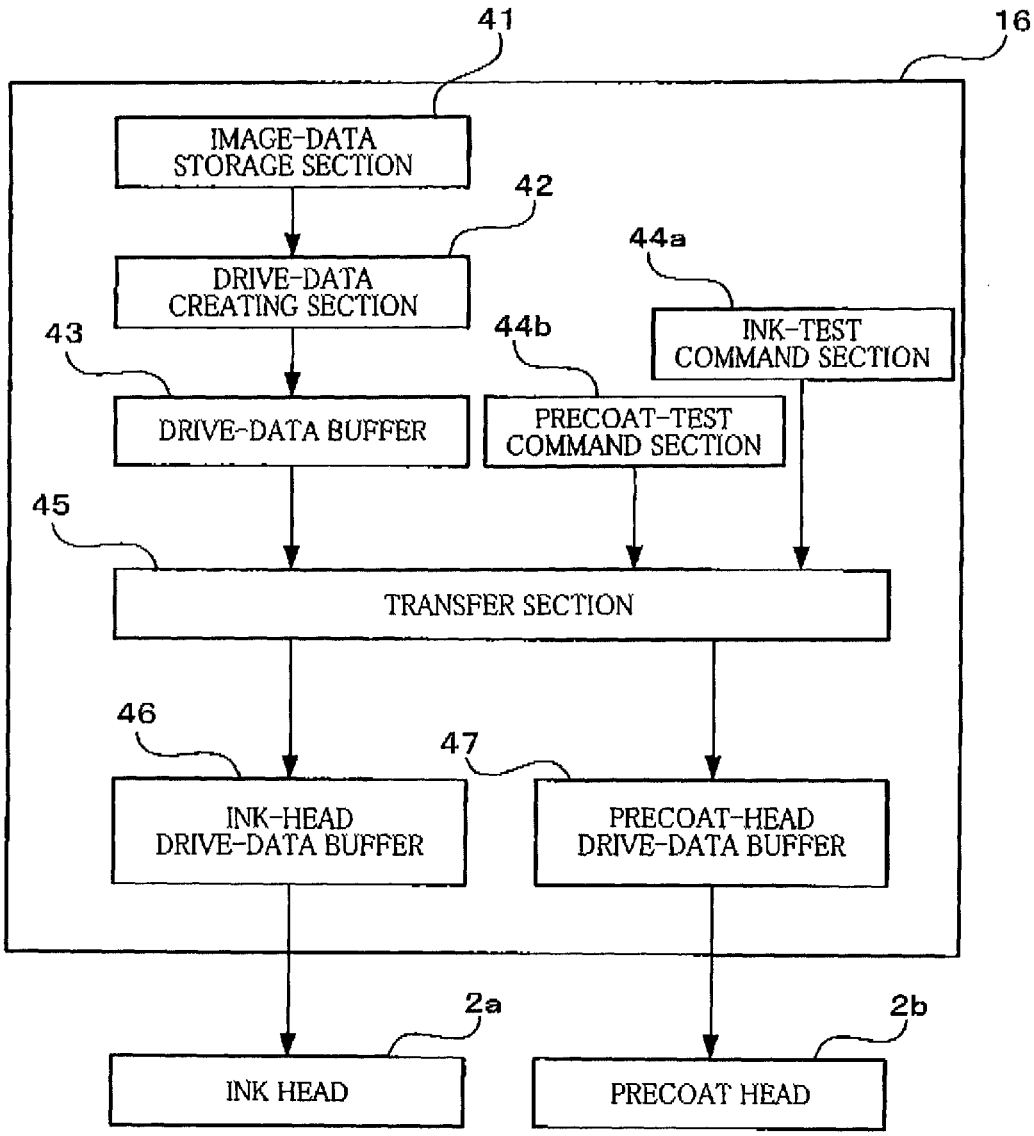
FIG. 2 is a functional block diagram of a controller shown in FIG. 1.

There will be next explained the controller 16 with reference to FIG. 2. As shown in FIG. 2, the controller 16 includes various functional sections such as an image-data storage section 41 as one example of a recording-data storage device, a drive-data creating section 42, a drive-data buffer 43, an ink-test command section 44*a*, a precoat-test command section 44*b*, a transfer section 45 as one example of an output controller, an ink-head drive-data buffer 46, and a precoat-head drive-data buffer 47. The controller 16 further includes: a central processing unit (CPU); an electrically erasable and programmable read only memory (EEPROM) rewritably storing therein programs to be executed by the CPU and data used for these programs; and a random access memory (RAM) temporarily storing therein data upon execution of the programs. These various functional sections are constituted by cooperation of these hardware and software in the EEPROM with each other. These programs are stored in various recording media such as a flexible disc, a CD-ROM, and a memory card, and installed into the EEPROM from these recording media. It is noted that the control programs stored in the recording media may be executed directly by the CPU and may be programs that become executable by being installed into the EEPROM. Further, the control programs may be encrypted and/or compressed.

The image-data storage section 41 stores one or more image data (recording data) transmitted from an external device and received together with a print command. This image data contains a gray level value (one of 0-255, for example) for each of a plurality of pixels arranged in matrix.

The drive-data creating section 42 is configured, based on the image data stored in the image-data storage section 41, to create drive data for driving the heads 2*a*, 2*b* to form a dot in each pixel. The drive-data buffer 43 is configured to temporarily store the drive data created by the drive-data creating section 42. It is noted that, in the present embodiment, the drive-data creating section 42 creates the drive data in a state in which the image data is completely stored in the image-data storage section 41, but the drive-data creating section 42 may start to create the drive data in a state in which the image data is partly stored in the image-data storage section 41.

The ink-test command section 44*a* is configured to command printing of an ink test pattern in response to a test-pattern print command transmitted from an external device.

The ink test pattern is used for a calibration of the ink head 2*a*. The precoat-test command section 44*b* is configured to command printing of a precoat test pattern in response to the test-pattern print command transmitted from the external device. The precoat test pattern is used for a calibration of the precoat head 2*b*. The print command outputted from the ink-test command section 44*a* for printing the ink test pattern and the print command outputted from the precoat-test command section 44*b* for printing the precoat test pattern are not executed at the same time. That is, when the ink-test command section 44*a* and the precoat-test command section 44*b* simultaneously output the print command for printing the ink test pattern and the print command for printing the precoat test pattern, respectively, one of the print commands is executed first, and the other print command waits until the execution of the one print command is finished.

The transfer section 45 includes a multiplexer and, based on a presence or absence of the commands outputted from the ink-test command section 44*a* and/or the precoat-test command section 44*b*, transfers the drive data temporarily stored in the drive-data buffer 43 selectively to at least one of the ink-head drive-data buffer 46 and the precoat-head drive-data buffer 47. Specifically, when neither the ink-test command section 44*a* nor the precoat-test command section 44*b* outputs the print command for printing the test pattern, that is, when the normal recording is performed, the transfer section 45 transfers the drive data temporarily stored in the drive-data buffer 43 to the ink-head drive-data buffer 46 and the precoat-head drive-data buffer 47 in parallel.

Figure 3A:
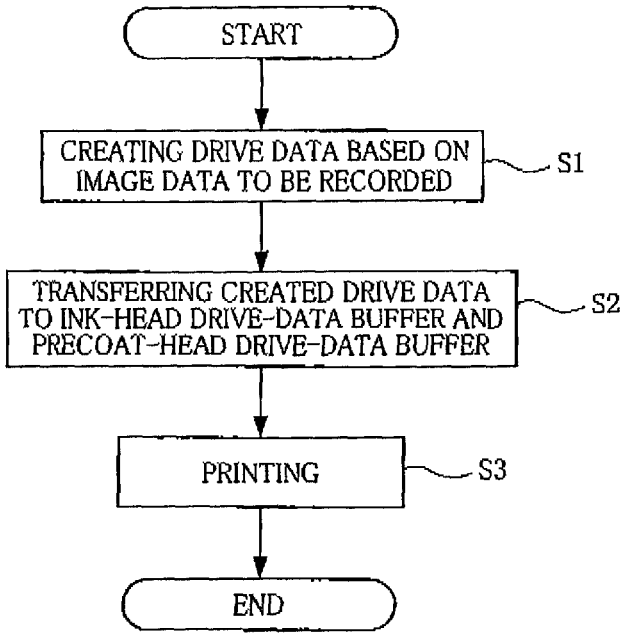
FIG. 3A is a flow-chart showing a print operation performed by the ink-jet printer shown in FIG. 1.

There will be next explained the print operation of the ink-jet printer 1 with reference to FIG. 3A. As shown in FIG. 3A, when the print command is transmitted from the external device to the ink-jet printer 1, that is, when the print command (a normal print command) is transmitted from the external device for printing an image such as a document desired by the user, image data representative of the image desired by the user (hereinafter may be referred to as "image data representative of the image to be recorded") is stored into the image-data storage section 41. In S1, the drive-data creating section 42 creates the drive data based on the image data stored in the image-data storage section 41 which is representative of the image to be recorded. The created drive data is temporarily stored into the drive-data buffer 43. Then in S2, the transfer section 45 transfers the drive data temporarily stored in the drive-data buffer 43, to both of the ink-head drive-data buffer 46 and the precoat-head drive-data buffer 47. Then in S3, the precoat head 2*b* ejects the precoat liquid onto the sheet P, and then the ink head 2*a* ejects liquid droplets of the ink, so that the liquid droplets of the ink are landed on areas on which the precoat liquid has been applied.

When the ink-test command section 44*a* outputs the print command for printing the ink test pattern, the transfer section 45 transfers the drive data temporarily stored in the drive-data buffer 43 only to the ink-head drive-data buffer 46. When the precoat-test command section 44*b* outputs the print command for printing the precoat test pattern, the transfer section 45 transfers the drive data temporarily stored in the drive-data buffer 43 only to the precoat-head drive-data buffer 47.

The ink-head drive-data buffer 46 is configured to output the drive data transferred to the transfer section 45, to the ink head 2*a*. The ink head 2*a* ejects the ink droplets based on this outputted drive data. The precoat-head drive-data buffer 47 is configured to output the drive data transferred to the transfer section 45, to the precoat head 2*b*. The precoat head 2*b* ejects the precoat liquid based on this outputted drive data.

As described above, in the case of the normal recording, the drive data created based on the image data is outputted to both of the ink head 2*a* and the precoat head 2*b*. Thus, the liquid droplets of the ink are landed on the areas on which the precoat liquid has been applied. On the other hand, in the case of the recording of the test pattern, the drive data representative of the precoat test pattern is outputted only to the precoat head 2*b*, and the drive data representative of the ink test pattern is outputted only to the ink head 2*a*. Thus, the precoat test pattern and the ink test pattern do not overlap each other on the sheet P.

Figure 3B:
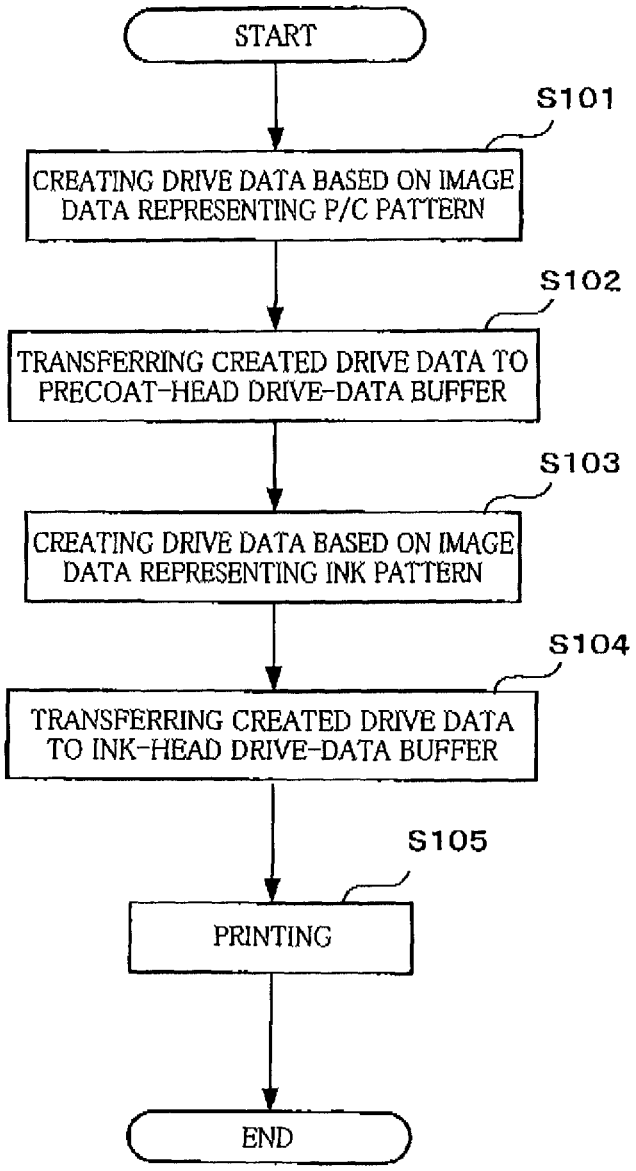
FIG. 3B is a flow-chart showing a print operation for recording a test pattern by the ink-jet printer shown in FIG. 1.

There will be next explained a print operation of the ink-jet printer 1 for printing the test pattern with reference to FIG. 3B. As shown in FIG. 3B, when the print command for printing the test pattern is received from the external device, the image data representative of the test pattern is stored into the image-data storage section 41. The image data stored in the image-data storage section 41 includes: image data representative of the precoat (P/C) test pattern formed of the precoat liquid as one example of the test pattern; and image data representative of the ink test pattern formed of the ink as another example of the test pattern. In S101, the drive-data creating section 42 creates the drive data based on the image data representative of the precoat test pattern stored in the image-data storage section 41. The created drive data is temporarily stored into the drive-data buffer 43. The precoat-test command section 44*b* commands the printing of the precoat test pattern. In response to this command, the transfer section 45 in S102 transfers the drive data temporarily stored in the drive-data buffer 43 only to the precoat-head drive-data buffer 47. It is noted that since the image data stored in the image-data storage section 41 is stored in response to the print command for printing the test pattern, where the command for printing the test pattern is for printing only the precoat (P/C) test pattern of the precoat liquid, only the image data representative of the precoat (P/C) test pattern of the precoat liquid is included in the image data stored in the image-data storage section 41. Likewise, where the command for printing the test pattern is for printing only the ink test pattern, only the image data representative of the ink test pattern is included in the image data stored in the image-data storage section 41.

In S103, the drive-data creating section 42 creates the drive data based on the image data representative of the ink test pattern stored in the image-data storage section 41. The created drive data is temporarily stored into the drive-data buffer 43. The ink-test command section 44*a* commands the printing of the ink test pattern. In response to this command, the transfer section 45 in S104 transfers the drive data temporarily stored in the drive-data buffer 43 only to the ink-head drive-data buffer 46.

In S105, in order to record a predetermined test pattern on the sheet P, the drive data transferred to the precoat-head drive-data buffer 47 is outputted to the precoat head 2*b*, and the drive data transferred to the ink-head drive-data buffer 46 is outputted to the ink head 2*a*. The test pattern including the precoat test pattern and the ink test pattern is recorded on the sheet P, and the processing shown in FIG. 3B is finished.

Figure 4A:
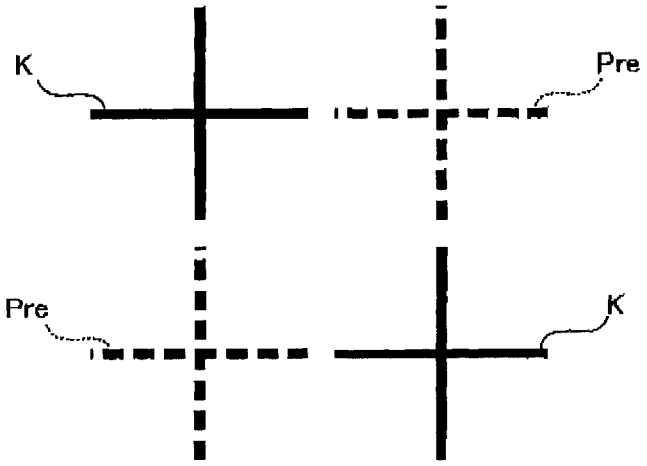
FIGS. 4A-4C are views each showing one example of a test pattern recorded according to the flow-chart shown in FIG. 3.
Figure 4B:
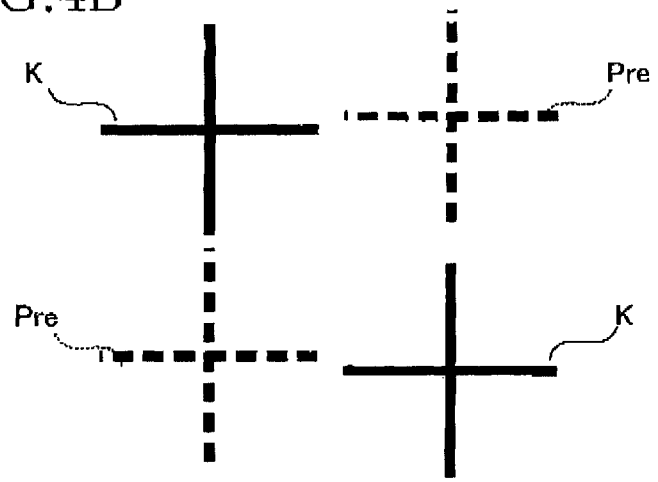
Figure 4C:
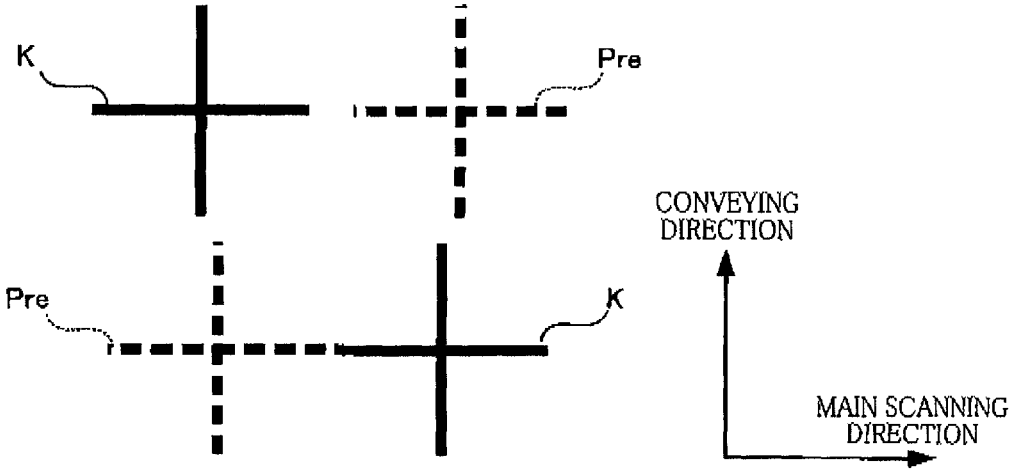

There will be next explained one example of the test pattern recorded according to the above-described processing with reference to FIGS. 4A-4C. In FIGS. 4A-4C, cross marks drawn in solid lines indicate the ink test patterns, and cross marks drawn in broken lines indicate the precoat test patterns. It is noted that the precoat test pattern is colorless but can be visually recognized by a user using a specific light or camera. As shown in FIG. 4A, in this test pattern, the ink test patterns and the precoat test patterns are alternately arranged in both of a conveying direction in which the sheet P is conveyed and a main scanning direction that is perpendicular to the conveying direction. In a test (examination) processing of the ink-jet printer 1, a registration is performed using the recorded test pattern to adjust a displacement between a position at which the ink is ejected and a position at which the precoat liquid is ejected. There will be explained one example of the registration.

FIG. 4A shows the test pattern in the case where the registration has been completed. In a case where there is displacement between ejection timings of the ink head 2*a* and the precoat head 2*b*, even if the recording operation is performed such that the test pattern shown in FIG. 4A is to be formed, each of the ink test patterns and a corresponding one of the precoat test patterns, as shown in FIG. 4B, are displaced from each other in the conveying direction in the recorded test pattern. In a case where there is displacement between fixed positions of the ink head 2*a* and the precoat head 2*b* in the main scanning direction, even if the recording operation is performed such that the test pattern shown in FIG. 4A is to be formed, each of the ink test patterns and a corresponding one of the precoat test patterns, as shown in FIG. 4C, are displaced from each other in the main scanning direction in the recorded test pattern. The registration is completed by adjusting the ejection timings and the fixed positions of the heads 2*a*, 2*b* such that the test pattern shown in FIG. 4A is to be recorded in which each of the ink test patterns and a corresponding one of the precoat test patterns are aligned to each other in the conveying direction and the main scanning direction. It is noted that only the ejection timing and the fixed position of the precoat head 2*b* may be adjusted using the ink head 2*a* as a reference, and alternatively, only the ejection timing and the fixed position of the ink head. 2*a* may be adjusted using the precoat head 2*b* as a reference.

In the ink-jet printer 1 as the present embodiment, the image data (the drive data) is selectively supplied to at least one of the ink head 2*a* and the precoat head 2*b*, and when the precoat test pattern is recorded on the sheet P, the drive data representative of the precoat test pattern is outputted only to the precoat head 2*b* without being outputted to the ink head 2*a*. Thus, the precoat test pattern can be recorded without overlapping the ink. Further, when the ink test pattern is recorded on the sheet P, the drive data representative of the ink test pattern is outputted only to the ink head 2*a* without being outputted to the precoat head 2*b*. Thus, the ink test pattern can be recorded without overlapping the precoat liquid.

Further, since the ink-head drive-data buffer 46 and the precoat-head drive-data buffer 47 are provided, it is easy to design a configuration in which the drive data representative of the precoat test pattern is outputted only to the precoat head 2*b*. Moreover, different drive data can be easily outputted to the ink head 2*a* and the precoat head 2*b*, respectively.

Further, since the transfer section 45 includes the multiplexer, these configurations can be easily designed.

Second Embodiment

Figure 5:
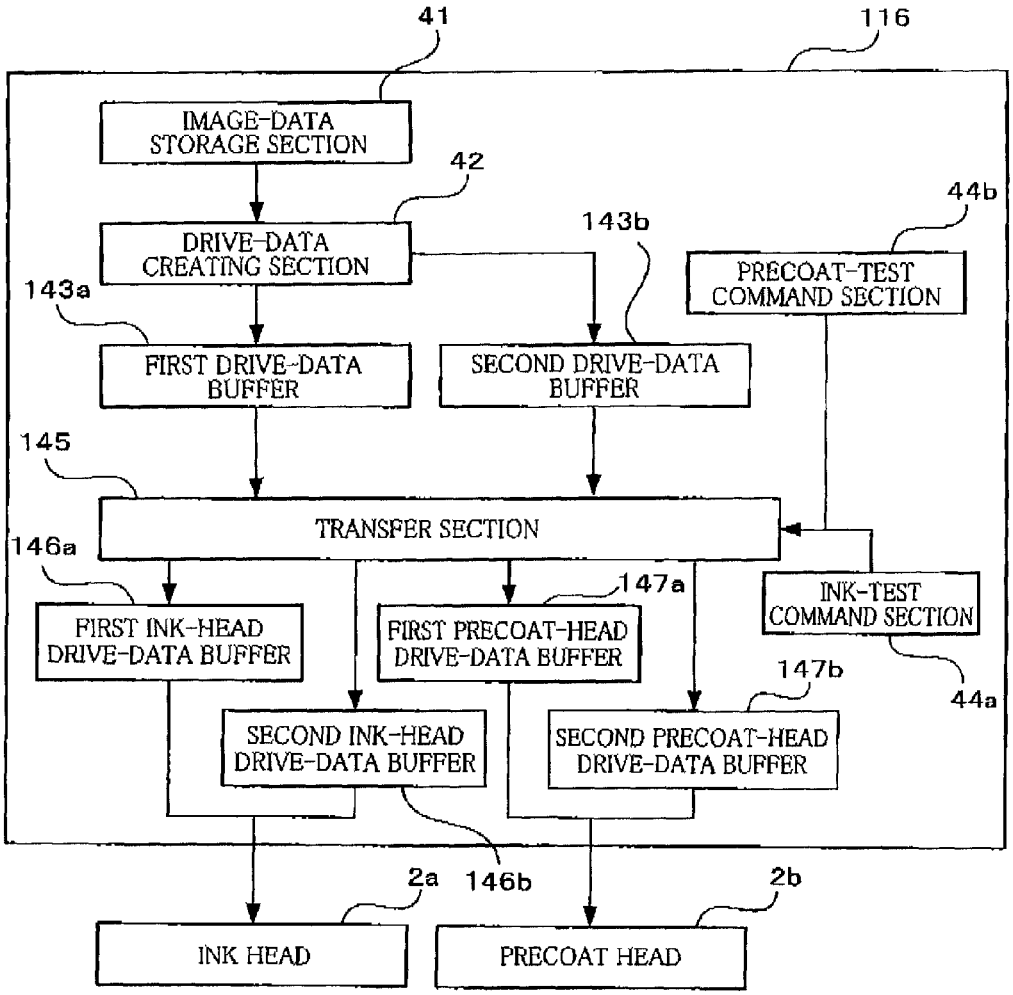
FIG. 5 is a functional block diagram of a controller of an ink-jet printer as a second embodiment.

There will be next explained a second embodiment of the present invention. It is noted that the same reference numerals as used in the first embodiment are used to designate the corresponding elements of the second embodiment, and an explanation of which is dispensed with. As shown in FIG. 5, a controller 116 includes, as functional sections, the image-data storage section 41, the drive-data creating section 42, a first drive-data buffer 143*a*, a second drive-data buffer 143*b*, the ink-test command section 44*a*, the precoat-test command section 44*b*, a transfer section 145, a first ink-head drive-data buffer 146*a*, a second ink-head drive-data buffer 146*b*, a first precoat-head drive-data buffer 147*a*, and a second precoat-head drive-data buffer 147*b*.

The first drive-data buffer 143*a* and the second drive-data buffer 143*b* temporarily stores the drive data stored in and transmitted from the drive-data creating section 42 in order.

The transfer section 145, based on the commands outputted from the ink-test command section 44*a* and/or the precoat-test command section 44*b*, transfers the drive data temporarily stored in the first and second drive-data buffers 143*a*, 143*b* selectively to one or ones of the first and second ink-head drive-data buffers 146*a*, 146*b* and the first and second precoat-head drive-data buffers 147*a*, 147*b*. Specifically, when neither the ink-test command section 44*a* nor the precoat-test command section 44*b* outputs the print command for printing the test pattern, that is, when the normal recording is performed, the transfer section 145 transfers the drive data temporarily stored in the first drive-data buffer 143*a* to the first ink-head drive-data buffer 146*a* and the first precoat-head drive-data buffer 147*a* and transfers the drive data temporarily stored in the second drive-data buffer 143*b* to the second ink-head drive-data buffer 146*b* and the second precoat-head drive-data buffer 147*b* in parallel in the order in which the data are temporarily stored. Alternatively, the transfer section 145 transfers the drive data temporarily stored in the first drive-data buffer 143*a* to the second ink-head drive-data buffer 146*b* and the second precoat-head drive-data buffer 147*b* and transfers the drive data temporarily stored in the second drive-data buffer 143*b* to the first ink-head drive-data buffer 146*a* and the first precoat-head drive-data buffer 147*a* in parallel in the order in which the data are temporarily stored.

When the ink-test command section 44*a* outputs the print command for printing the ink test pattern, the transfer section 145 transfers the drive data temporarily stored in the first drive-data buffer 143*a*, only to the first ink-head drive-data buffer 146*a*. Further, when the precoat-test command section 44*b* outputs the print command for printing the precoat test pattern, the transfer section 145 transfers the drive data temporarily stored in the second drive-data buffer 143*b*, only to the second precoat-head drive-data buffer 147*b*.

The first and second ink-head drive-data buffers 146*a*, 146*b* output the drive data transferred to the transfer section 145, to the ink head 2*a* in the order in which the drive data are transferred. The first and second precoat-head drive-data buffers 147*a*, 147*b* output the drive data transferred to the transfer section 145, to the precoat head 2*b* in the order in which the drive data are transferred. Here, the first ink-head drive-data buffer 146*a* and the first precoat-head drive-data buffer 147*a* output the drive data respectively to the ink head 2*a* and the precoat head 2*b* such that the precoat head 2*b* and the ink head 2*a* respectively eject the precoat liquid and the ink to the same positions on the recording medium, and the second ink-head drive-data buffer 146*b* and the second precoat-head drive-data buffer 147*b* output the drive data respectively to the ink head 2*a* and the precoat head 2*b* such that the precoat head 2*b* and the ink head 2*a* respectively eject the precoat liquid and the ink to the same positions on the recording medium.

As described above, in the case of the normal recording, the drive data created based on the image data is outputted from the first ink-head drive-data buffer 146*a* and the first precoat-head drive-data buffer 147*a*, or the second ink-head drive-data buffer 146*b* and the second precoat-head drive-data buffer 147*b* to both of the ink head 2*a* and the precoat head 2*b*. Thus, the liquid droplets of the ink are landed on the areas on which the precoat liquid has been applied. On the other hand, in the case of the recording of the test pattern, the drive data representative of the precoat test pattern is outputted from the second precoat-head drive-data buffer 147*b* only to the precoat head 2*b*, and the drive data representative of the ink test pattern is outputted from the first ink-head drive-data buffer 146*a* only to the ink head 2*a*. Thus, the precoat test pattern and the ink test pattern do not overlap each other.

Figure 6:
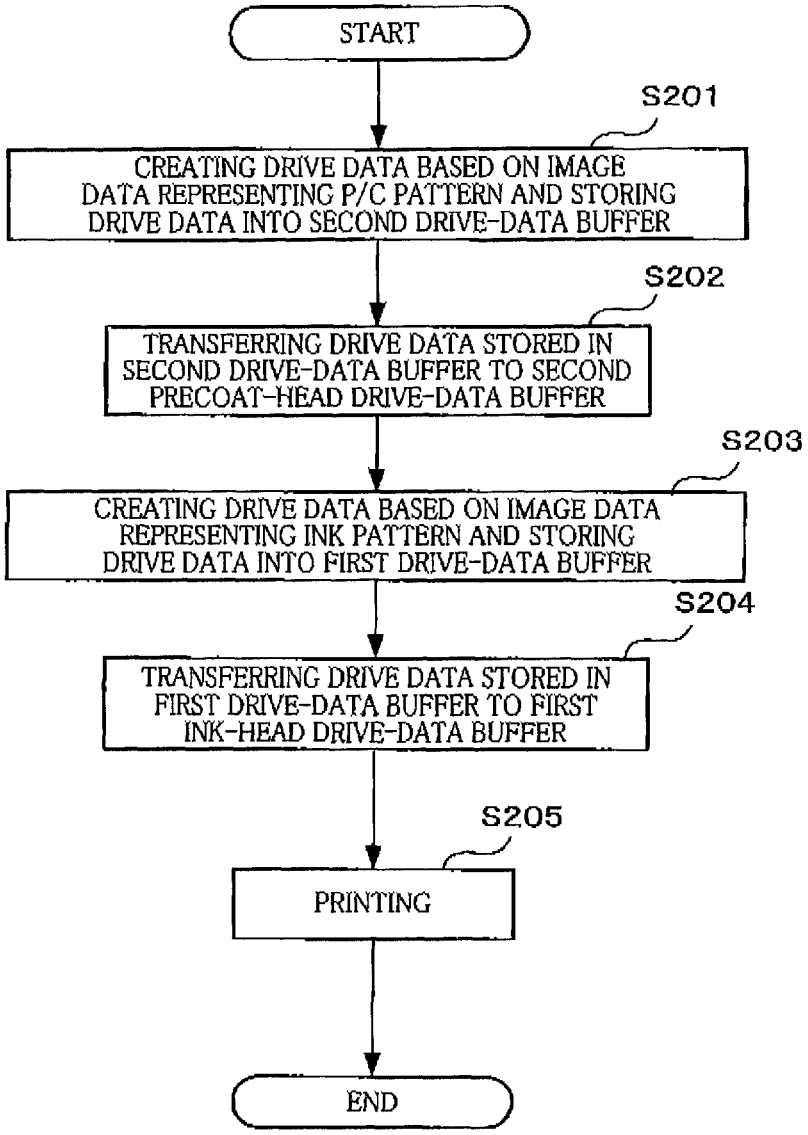
FIG. 6 is a flow-chart showing a print operation for recording a test pattern by the ink-jet printer shown in FIG. 5.

There will be next explained a print operation of the ink-jet printer as the present embodiment for printing the test pattern with reference to FIG. 6. As shown in FIG. 6, when, the print command for printing the test pattern is received from the external device, the drive-data creating section 42 in S201 converts the image data representative of the precoat test pattern stored in the image-data storage section 41, to the drive data. The converted drive data is temporarily stored into the second drive-data buffer 143*b*. Then in S202, the transfer section 145 transfers the drive data temporarily stored in the second drive-data buffer 143*b*, only to the second precoat-head drive-data buffer 147*b*.

In S203, the drive-data creating section 42 creates the drive data from the image data representative of the ink test pattern stored in the image-data storage section 41. The created drive data is temporarily stored into the first drive-data buffer 143*a*. In S204, the transfer section 145 transfers the drive data temporarily stored in the first drive-data buffer 143*a*, only to the first ink-head drive-data buffer 146*a*.

Then in S205, the drive data transferred to the second precoat-head drive-data buffer 147*b* is outputted to the precoat head 2*b*, and the drive data transferred to the first ink-head drive-data buffer 146*a* is outputted to the ink head 2*a* to record the predetermined test pattern on the sheet P. As a result, the test pattern including the precoat test pattern and the ink test pattern is recorded on the sheet P, and the processing shown in FIG. 6 is finished.

In the ink-jet printer as the present embodiment, the image data (the drive data) is selectively supplied to at least one of the ink head 2*a* and the precoat head 2*b*, and when the precoat test pattern is recorded on the sheet P, the drive data representative of the precoat test pattern is outputted only to the precoat head 2*b* without being outputted to the ink head 2*a*. Thus, the precoat test pattern can be recorded without overlapping the ink. Further, when the ink test pattern is recorded on the sheet P, the drive data representative of the ink test pattern is outputted only to the ink head 2*a* without being outputted to the precoat head 2*b*. Thus, the ink test pattern can be recorded without overlapping the precoat liquid.

Further, two image data (two sets of the image data) can be processed in parallel by the first drive-data buffer 143*a*, the second drive-data buffer 143*b*, the first ink-head drive-data buffer 146*a*, the second ink-head drive-data buffer 146*b*, the first precoat-head drive-data buffer 147*a*, the second precoat-head drive-data buffer 147*b*, and the transfer section 145. Thus, the plurality of the image data can be processed at the same time in the normal recording that is performed when the print command for printing the test pattern is not outputted. Further, when the print command for printing the test pattern is outputted, the different drive data can speedily outputted to the ink head 2*a* and the precoat head 2*b*, respectively.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, in the above-described embodiments, the precoat liquid is not ejected when the ink test pattern is recorded on the sheet P, but the precoat liquid may also be ejected when the ink test pattern is recorded on the sheet P. It is noted that the precoat liquid is colorless and transparent, and thus even if the precoat liquid contacts or overlaps the ink, the ink test pattern can be used as in the above-described embodiments without loss of its function.

In the above-described embodiments, the ink-head drive-data buffer 46 and the precoat-head drive-data buffer 47 are provided, but the drive data may be directly outputted to the heads without providing these buffers.

In the above-described embodiments, the drive data representative of the precoat test pattern is outputted in response to the print command for printing the precoat test pattern by the precoat-test command section 44*b*, but not only the drive data representative of the precoat test pattern but also the drive data representative of the ink test pattern may be outputted in response to the print command for printing the precoat test pattern by the precoat-test command section 44*b*.

In the above-described embodiments, the transfer section includes the multiplexer, but a configuration of the hardware is not limited to this one.

In the above-described embodiments, the precoat test pattern and the ink test pattern are recorded on one sheet, but the print command for printing the precoat test pattern and the print command for printing the ink test pattern may be judged based on the print commands in the units of the sheets. Alternatively, the print command for printing the precoat test pattern and the print command for printing the ink test pattern may be judged in units of any areas on the sheet.

Further, in the above-described second embodiment, when the ink-test command section 44*a* outputs the print command for printing the ink test pattern, the transfer section 145 transfers the drive data temporarily stored in the first drive-data buffer 143*a*, only to the first ink-head drive-data buffer 146*a*, and when the precoat-test command section 44*b* outputs the print command for printing the precoat test pattern, the transfer section 145 transfers the drive data temporarily stored in the second drive-data buffer 143*b*, only to the second precoat-head drive-data buffer 147*b*. However, the transfer section 145 may, when the ink-test command section 44*a* outputs the print command for printing the ink test pattern, transfer the drive data temporarily stored in the first drive-data buffer 143*a*, only to the second ink-head drive-data buffer 146*b*, and when the precoat-test command section 44*b* outputs the print command for printing the precoat test pattern, transfer the drive data temporarily stored in the second drive-data buffer 143*b*, only to the first precoat-head drive-data buffer 147*a*.

In the above-described embodiments, the single CPU of the controller 16 (116) executes all the processings. However, the present invention is not limited to this configuration. For example, the controller 16 (116) may use a plurality of CPUs, an application-specific integrated circuit (ASIC), or a combination of the CPU(s) and the ASIC to execute the processings explained above.

While the precoat liquid is used as the second liquid in the above-described embodiments, a post-treatment liquid (post-coat liquid) may be used as the second liquid. In such a case, a second-liquid ejection head for ejecting the post-coat liquid is disposed downstream of the first-liquid ejection head in the conveying direction.

The present invention is applicable to a liquid ejection apparatus configured to eject liquid other than the ink. The present invention is applicable not only to the printer but also to various devices for image recording such as a facsimile machine and a copying machine.

What is claimed is:

1. An image recording apparatus, comprising:

a conveyor mechanism configured to convey a recording medium in a conveying direction;

a first-liquid ejection head having at least one first ejection opening, the first-liquid ejection head configured to eject first liquid for recording an image on the recording medium through the first ejection opening;

a second-liquid ejection head having at least one second ejection opening, the second-liquid ejection head configured to eject transparent liquid as second liquid through the second ejection opening;

a recording-data storage device configured to store therein recording data representative of one of an image to be recorded and an image of a test pattern of the first liquid and the second liquid;

a drive-data creating section configured to create drive data for driving at least one of the first-liquid ejection head and the second-liquid ejection head based on the recording data stored in the recording-data storage device;

a first buffer and a second buffer configured to store the driving data transmitted from the drive-data creating section in order;

a third buffer and a fourth buffer configured to store the driving data, for ejection of the first-liquid ejection head, respectively transmitted from the first buffer and the second buffer in the order in which the driving data are stored in the first buffer and the second buffer;

a fifth buffer and a sixth buffer configured to store the driving data, for ejection of the second-liquid ejection head, respectively transmitted from the first buffer and the second buffer in the order in which the driving data are stored in the first buffer and the second buffer;

a first-liquid test-pattern recording command section configured to command recording of the test pattern of the first liquid on the recording medium;

a second-liquid test-pattern recording command section configured to command recording of the test pattern of the second liquid on the recording medium; and an output controller configured to:

control the first buffer to output the driving data stored in the first buffer only to the third buffer when the first-liquid test pattern recording command section commands the recording of the first liquid;

control the second buffer to output the driving data stored in the second buffer only to the sixth buffer when the second-liquid test-pattern recording command section commands the recording of the test pattern of the second liquid; and control the third buffer and the sixth buffer to output the driving data stored in the third buffer and the sixth buffer to the first-liquid ejection head and the second-liquid ejection head respectively in the order in which the driving data are stored in the third buffer and the sixth buffer.

2. The image recording apparatus according to claim 1, wherein the second-liquid ejection head is provided upstream of the first-liquid ejection head in the conveying direction, and wherein the second liquid is liquid for coagulating or precipitating a constituent of the first liquid.

3. The image recording apparatus according to claim 1, wherein the output controller includes a multiplexer.

4. A nontransitory storage medium storing a program to be executed by a computer of an image recording apparatus, the image recording apparatus comprising:

a conveyor mechanism configured to convey a recording medium in a conveying direction;

a first-liquid ejection head having at least one first ejection opening, the first-liquid ejection head configured to eject first liquid for recording an image on the recording medium through the first ejection opening;

a second-liquid ejection head having at least one second ejection opening, the second-liquid ejection head configured to eject transparent liquid as second liquid through the second ejection opening; and a recording-data storage device configured to store therein recording data representative of one of an image to be recorded and an image of a test pattern of the second liquid, the program designed to have the computer function as:

a drive-data creating section configured to create drive data for driving at least one of the first-liquid ejection head and the second-liquid ejection head based on the recording data stored in the recording-data storage device;

a first buffer and a second buffer configured to store the driving data transmitted from the drive-data creating section in order;

a third buffer and a fourth buffer configured to store the driving data, for ejection of the first-liquid ejection head, respectively transmitted from the first buffer and the second buffer in the order in which the driving data are stored in the first buffer and the second buffer;

a fifth buffer and a sixth buffer configured to store the driving data, for ejection of the second-liquid ejection head, respectively transmitted from the first buffer and the second buffer in the order in which the driving data are stored in the first buffer and the second buffer;

a first-liquid test-pattern recording command section configured to command recording of the test pattern of the first liquid on the recording medium;

a second-liquid test-pattern recording command section configured to command recording of the test pattern of the second liquid on the recording medium; and an output controller configured to:

control of the first buffer to output the driving data stored in the first buffer only to the third buffer when the first-liquid test pattern recording command section commands the recording of the first liquid;

control the second buffer to output the driving data stored in the second buffer only to the sixth buffer when the second-liquid test-pattern recording command section commands the recording of the test pattern of the second liquid; and control the third buffer and the sixth buffer to output the driving data stored in the third buffer and the sixth buffer to the first-liquid ejection head and the second-liquid ejection head respectively in the order in which the driving data are stored in the third buffer and the sixth buffer.

5. The image recording apparatus according to claim 1, further comprising an image recording command section configured to command recording of the image to be recorded on the recording medium, wherein the output controller is configured to:

control the first buffer to output the driving data stored in the first buffer to the third buffer and the fifth buffer when the image recording command section commands the recording of the image to be recorded on the recording medium;

control the second buffer to output the driving data stored in the second buffer to the fourth buffer and sixth buffer when the image recording command section commands the recording of the image to be recorded on the recording medium;

control the third buffer and the fifth buffer to output the driving data stored in the third buffer and the fifth buffer to the first-liquid ejection head and the second-liquid ejection head respectively at the same time; and control the fourth buffer and the sixth buffer to output the driving data stored in the fourth buffer and the sixth buffer to the first-liquid ejection buffer and the second-liquid ejection buffer respectively at the same time.

* * * * *